United States Patent [19]

Girault et al.

[11] Patent Number: 4,995,632

[45] Date of Patent: Feb. 26, 1991

[54] BINDING DEVICE FOR SKI BOOT

[75] Inventors: Eric Girault, Seynod; Paul Arnulf, Alby sur Cheran, both of France

[73] Assignee: Salomon S. A., Annecy Cedex, France

[21] Appl. No.: 508,128

[22] Filed: Apr. 12, 1990

[30] Foreign Application Priority Data

Apr. 12, 1989 [FR] France ..... 89 05166

[51] Int. Cl.[5] ..... A63C 9/086

[52] U.S. Cl. ..... 280/615; 280/631

[58] Field of Search ..... 280/614, 615, 617, 623, 280/630, 631, 633, 634

[56] References Cited

U.S. PATENT DOCUMENTS

| | | | |
|---|---|---|---|
| 3,261,041 | 7/1966 | Roley | 280/633 |
| 4,524,990 | 6/1985 | Svoboda et al. | 280/633 |
| 4,691,936 | 9/1987 | Nowak et al. | 280/615 |
| 4,871,337 | 10/1989 | Harris | 280/633 |
| 4,927,168 | 5/1990 | Provence et al. | 280/615 |
| 4,928,988 | 5/1990 | Hue | 280/615 |

*Primary Examiner*—Charles A. Marmor
*Assistant Examiner*—Richard Camby
*Attorney, Agent, or Firm*—Pollock, Vande Sande & Priddy

[57] ABSTRACT

The device comprises two jaws (10, 20) designed to lock the hinge pin of the ski boot while leaving this pin free to rotate. One of the jaws (10l) is stationary and the other jaw (20) is movable and displaceable toward the stationary jaw (10) in order to grip the hinge pin, and the stationary jaw (1) delimits a slide track which guides a guide piece (23) connected to the movable locking jaw (20). The guide rail (12) is positioned between two screws (5) for mounting the device on the ski and extends transversely under at least one part of the support area of each screw head (5).

8 Claims, 1 Drawing Sheet

BINDING DEVICE FOR SKI BOOT

The present invention concerns a mounting device, called a "hinge", for cross-country ski boots having, at their front end, a transverse hinge pin which is locked in position but left free to rotate, the locking action being produced between a stationary jaw of the mounting device and a movable jaw unitary with a slidable locking carriage.

BACKGROUND OF THE INVENTION

In a mounting device of this type, disclosed in Applicant's FR No. 88.14048, the stationary jaw of the locking system delimits, in its lower part, a guidance slide track for a guide piece connected to the movable jaw constituted by an axial extension of the latter. This known mounting device calls for the embedding of the guide piece of the locking slide in the associated part of the slide track. An arrangement of this kind allows the stresses exerted on the movable jaw during cross-country skiing to be transmitted to the slide track, but requires that the jaw be stationary and that the slide track which it delimits be made of a treated steel capable of bearing the additional stresses generated in the slide track. A steel slide track of this kind also poses manufacturing problems because of the complexity of the shapes to be produced.

SUMMARY OF THE INVENTION

The purpose of the present invention is to remedy this problem and to provide a guide system allowing the absorption of the stresses exerted on the locking slide. The system is of simple design and does not lead to the oversizing or excessive cost of the guidance slide track. The system further allows the manufacture of the slide track using current manufacturing injection methods.

This goal is achieved in the mounting device according to the invention of the above-mentioned type, i.e., comprising two jaws designed to lock the hinge pin of the boot in position while allowing the pin to rotate, one of the jaws being stationary and the other being movable and capable of being displaced toward the fixed jaw in order to clamp the hinge pin, and the fixed jaw delimiting a guidance slide track for an associated guide piece on the movable locking jaw because of the fact that the guidance slide track is positioned between two screws for mounting the device on the ski, the slide rail extending transversely beneath at least one part of the support zone of each screw head.

An arrangement of this kind indeed allows the mounting screws to directly absorb the stresses exerted on the slide rail by the movable jaw, and therefore makes it possible to reduce the tensions within the stationary jaw.

According to a preferred embodiment of the invention, the two screws are arranged along a single line perpendicular to the longitudinal axis of the ski and at the level of the locking area of the boot pin, thereby allowing the direct transmission to these screws of the stresses exerted on the movable jaw.

Advantageously, the two mounting screws have conical bearing surfaces, thereby providing a larger stress-absorption surface.

Finally, according to yet another preferred embodiment, the mounting device comprises a third screw for mounting to the ski, which, with the two other crews, forms a triangle which encloses the locking zone of the boot pin.

An arrangement of this type makes it possible to avoid all effects arising from the projection of the movable jaw beyond the rest of the device, and is, therefore, especially advantageous.

BRIEF DESCRIPTION OF THE DRAWINGS

The mounting device according to the invention will be more clearly understood from the following description provided with reference to the attached drawings which illustrate, by way of example, a preferred embodiment of the invention and in which.

DESCRIPTION OF THE PREFERRED EMBODIMENT

Figure 1:
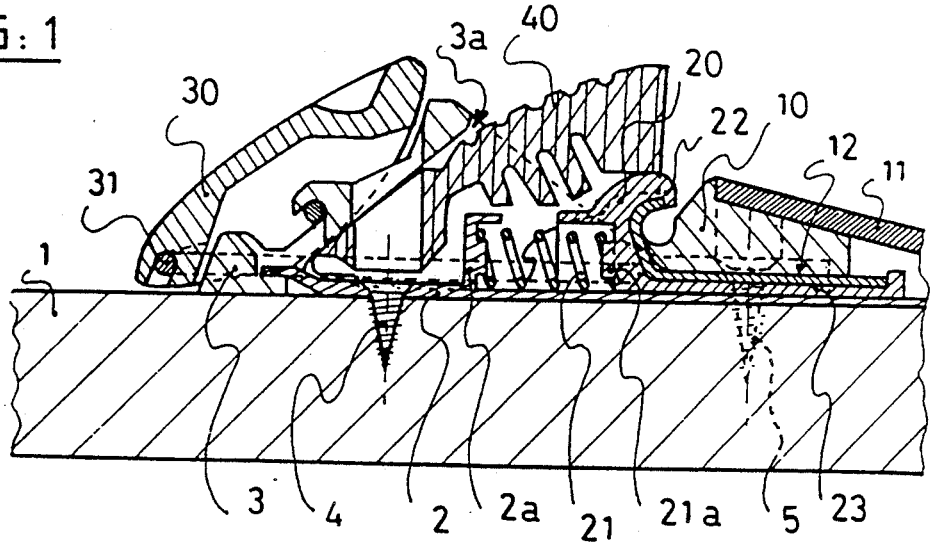
FIG. 1 is a longitudinal section view of a mounting device according to the invention.
Figure 2:
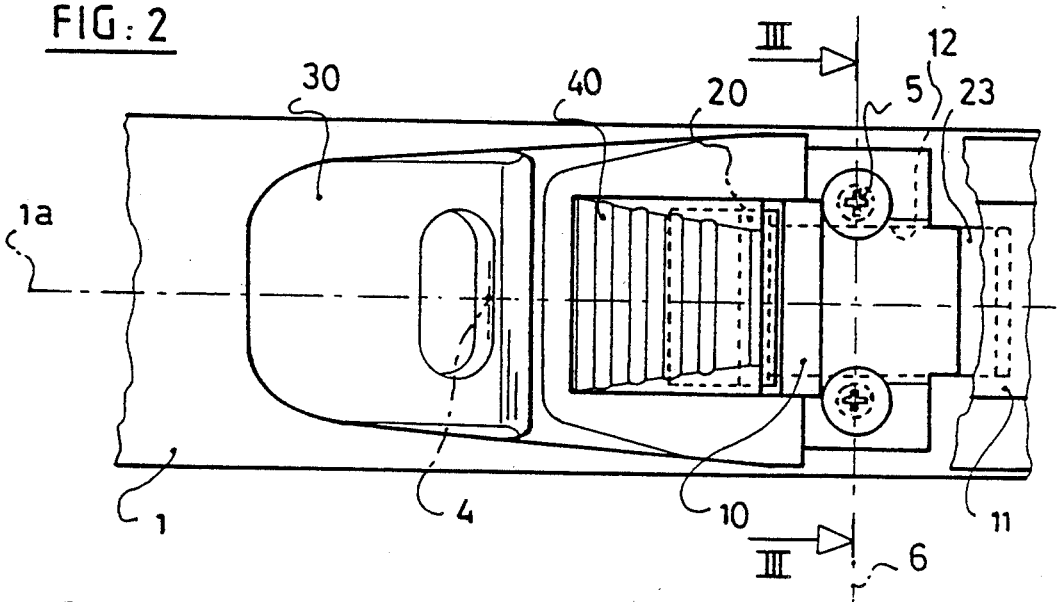
FIG. 2 is a top plan view of the device shown in FIG. 1.
Figure 3:
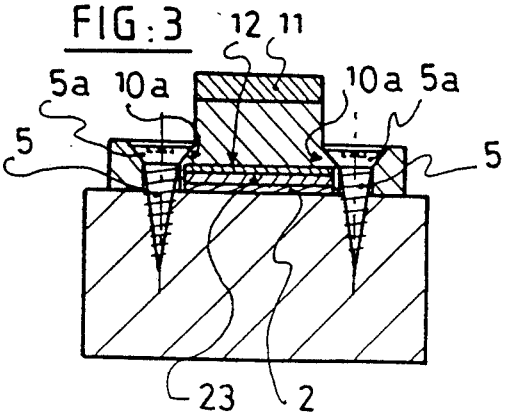
FIG. 3 is a section view along line III—III in FIG. 2.

The mounting device shown in FIGS. 1 to 3 is of the hinge type, i.e., it is designed to allow a boot to a be fastened to a ski while allowing the boot to rotate around a hinge pin perpendicular to the longitudinal axis of the ski, the hinge pin being attached to the front end of the boot. A boot of this type is conventionally known, and is therefore not shown in the drawings.

The mounting device basically comprises a seating 2, 3 designed to be fastened to the ski 1, a locking system constituted by a stationary jaw 10 and a movable jaw 20, , a release lever 30, and an elastic cushion 40 designed to draw the boot downward when the boot is raised off the upper surface of the ski.

In the illustrated embodiment, the seating is constituted by two pieces 2, 3 one fitted into the other and attached to the ski using three screws 4, 5 whose heads are countersunk. It will be observed that these three screws 4, 5 are arranged to form a triangle enclosing the locking zone, which comprises the stationary jaw 10 and the movable jaw 20.

As shown in FIG. 2, the first screw is arranged along the longitudinal axis 1*a* of the ski 1 and constitutes the apex of the triangle of screws, while the two other screws are arranged along a single axis 6 perpendicular to the longitudinal axis 1*a* of the ski 1 and constitute the base of the triangle of screws. The two screws 5 are also used to fasten the stationary locking jaw 10 on the ski.

The mounting device shown is termed an automatic mounting device, in which a spring 21 continuously pushes the movable locking jaw 20 into the locked position.

In the illustrated embodiment, the spring 21 is held between a projection 2*a* of seating part 2 and an associated projection 21*a* of jaw 20 The second part 3 of the seating incorporates a housing 3*a* for the elastic cushion 40, while also acting as a guide for the release lever 30.

It is evident that the seating 2, 3 may also be formed as a single piece.

The movable locking jaw 20 comprises a hook-shaped part 22 having a substantially C-shaped transverse section which constitutes the actual locking jaw.

This hook 22 extends rearward, i.e., in the direction of the stationary jaw 10, and is drawn toward this stationary jaw 10 by the spring 21 used to lock the pin of the boot in position.

Furthermore, the movable jaw 20 slides longitudinally and is guided by means of an axial extension piece 23 designed to cooperate with a slide track 12 which has a section complementary to that of the axial extension piece and is fitted beneath the stationary jaw.

A construction of this type is already known, for example, from FR No. 88.14048, cited above.

The release of the device is achieved by moving the movable jaw 20 forward, i.e., to the left in the drawing, by means of a lever 30 connected to this movable jaw 20 by a metal clamp 31. A release system of this type is disclosed in a copending application filed by the present applicant, and could, of course, be replaced by a different release system.

The stationary jaw 10 delimits a transversely-positioned housing having a substantially U-shaped section for the hinge pin of the boot. The jaw is embedded in a conventional guide ridge and delimits, in its lower portion, a guidance slide track 12 in the form of a parallelepiped for the axial extension piece 23 of the movable jaw 20.

As shown more particularly in FIG. 3, the guidance slide track 12 has a transverse section which is complementary to that of the axial extension piece 23 of the movable jaw 20, in the present instance a section that is substantially rectangular, and extends transversely up to a point beneath the head 5*a* of each of the mounting screws 5 of the stationary jaw 10, and, in consequence, beneath the support zone 10*a* of these screw heads 5 on the stationary jaw 10.

It will be easily understood that, because of this relative positioning of the slide rail 12 and of the screws 5, the latter can directly absorb the stresses being exerted on the movable jaw 20.

As a result, therefore, the tensions exerted by the movable jaw 20 on the slide rail 12 are substantially reduced, this reduction of stresses allowing the use of a plastic material in place of treated steel to make the jaw 10 delimiting this slide track 12.

Screws 4, 5 are shown in the drawings with countersunk heads, but they could have cylindrical heads instead.

It will be noted, however, that the use of screws with countersunk heads is advantageous, both because it provides a conical support or bearing surface 10*a* of the screws on the stationary jaw 10 which is larger than would be obtained using screws with cylindrical heads and because the conical shape of the screws 5, in contradistinction to cylindrical heads, allows a greater extension of the slide track beneath the screw heads, without increasing the height of the screw heads, and thus of the boot, above the ski.

For practical reasons, the slide track should extend transversely to its maximum width beneath the screw heads, while this width remains less than the external diameter of the screws.

The term "support zone or surface" 10*a* is to be understood in the rather broad sense of a direct or indirect support zone of the heads 5*a* of these screws 5 on the associated part of the stationary jaw 10.

Figure 4:
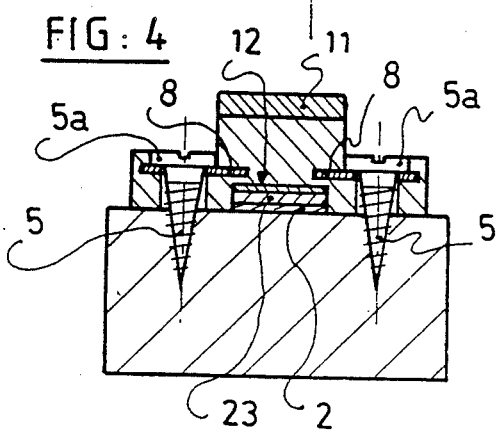
FIG. 4 is a view similar to that shown in FIG. 3, but of another embodiment.

Thus, particularly in the case of screws 5 with cylindrical heads, it is entirely conceivable that a washer or metal insert 8 could be interposed between the head of each screw 5 and the support surface 10*a* of the stationary jaw 10, this washer or insert extending toward the interior of the stationary jaw 10 and above the slide track 12, as shown in FIG. 4.

An arrangement of this kind allows the transfer of the stresses exerted on the movable jaw 20 to the screws 5 via the metal inserts 8, even if the axial extension piece 23 of the movable jaw 20 does not extend transversely under the heads of these screws 5. In this case, the inserts 8 may advantageously be incorporated into the stationary jaw during molding of the latter, and the bearing surface of the screws is substantially horizontal.

Of course, the use of washers or inserts is also entirely compatible with the use of screws with countersunk heads.

What is claimed is:

1. A mounting device for a ski boot on a cross-country ski, said ski boot having a transverse hinge pin at its front end, said mounting device comprising a stationary jaw and a moveable locking jaw designed to lock said hinge pin (2) of said ski boot in position while leaving said hinge pin free to rotate, and said moveable locking jaw is capable of being displaced toward said stationary jaw (10) in order to clamp said hinge pin, said stationary jaw (10) delimiting a slide track (12) for a guide piece (23) connected to said movable locking jaw (20), said slide track (12) being arranged between two screws (5) for mounting said device to said cross-country ski, said screws having screw heads (5*a*), and said slide track (12) extending transversely beneath at least one part of a support zone (10*a*) of each of said screw heads (5*a*).

2. A mounting device according to claim 1, wherein said support zone (10*a*) of each of said screws (5) is formed via a metal insert (8).

3. A mounting device according to claim 1, wherein said two screws (5) are located along a single line perpendicular to a longitudinal axis (1*a*) of said ski.

4. A mounting device according to claim 1, wherein said two screws (5) are arranged in a locking zone (10, 20) of the hinge pin when clamp 2 between said stationary jaw (10) and said moveable locking pin.

5. A cross-country mounting device according to claim 1, wherein said two screws (5) have conical bearing surfaces (10*a*).

6. A mounting device according to claim 2 wherein said two mounting screws (5) have substantially horizontal bearing surfaces.

7. A mounting device according to claim 2, wherein said slide track (12) is made of a synthetic material.

8. A mounting device according to claim 1, wherein said device comprises a third screw (4) for mounting to the cross-country ski, and wherein said third screw constitutes, jointly with the two other said screws, a triangle enclosing a locking zone (10, 20) in which said hinge pin of said ski boot is locked in position.

* * * * *

UNITED STATES PATENT AND TRADEMARK OFFICE

CERTIFICATE OF CORRECTION

PATENT NO. : 4,995,632

DATED : February 26, 1991

INVENTOR(S) : Girault et al

It is certified that error appears in the above-identified patent and that said Letters Patent is hereby corrected as shown below:

Col. 4, line 45 change "clamp 2" -- clamped--.

Col. 4, line 46 change "pin" to -- jaw--.

Signed and Sealed this

Nineteenth Day of January, 1993

*Attest:*

DOUGLAS B. COMER

*Attesting Officer*

*Acting Commissioner of Patents and Trademarks*